US006978782B2

(12) United States Patent
Tayebi

(10) Patent No.: US 6,978,782 B2
(45) Date of Patent: Dec. 27, 2005

(54) FULL FACE MASK

(76) Inventor: Amad Tayebi, 5 Sequoia Rd., Westford, MA (US) 01886

( * ) Notice: Subject to any disclaimer, the term of this patent is extended or adjusted under 35 U.S.C. 154(b) by 206 days.

(21) Appl. No.: 10/228,978

(22) Filed: Aug. 27, 2002

(65) Prior Publication Data

US 2004/0040561 A1 Mar. 4, 2004

(51) Int. Cl.[7] ..... A62B 7/10; A62B 18/02; A62B 23/02

(52) U.S. Cl. ..... 128/206.19; 128/201.17; 128/206.12; 128/206.21

(58) Field of Search ..... 128/201.17, 206.16, 128/206.19, 201.12, 206.23, 206.24, 206.28, 205.27, 205.29, 206.12, 206.21

(56) References Cited

U.S. PATENT DOCUMENTS 1,101,756 A * 6/1914 Nesvadba ..... 128/206.19
4,296,746 A * 10/1981 Mason et al. ..... 128/201.15
4,643,182 A * 2/1987 Klein ..... 128/201.25
5,243,972 A * 9/1993 Huang ..... 128/205.25
5,682,879 A * 11/1997 Bowers ..... 128/206.19
6,123,077 A * 9/2000 Bostock et al. ..... 128/206.12
6,176,239 B1 * 1/2001 Grove et al. ..... 128/206.24
6,543,450 B1 * 4/2003 Flynn ..... 128/206.19

* cited by examiner

*Primary Examiner*—Glenn K. Dawson
*Assistant Examiner*—Michael Mendoza

(57) ABSTRACT

Disclosed is a novel light weight inexpensive full face mask in which the air filtration function is carried out by an air filtration shell which has at least a portion of its surface made of a porous filtration material. The air filtration shell also acts as a breathing chamber. Also disclosed is a lower cost yet an effective method for providing a cooler breathing chamber and minimizing the volume of re-inhaled exhaled-air in any full face mask.

1 Claim, 14 Drawing Sheets

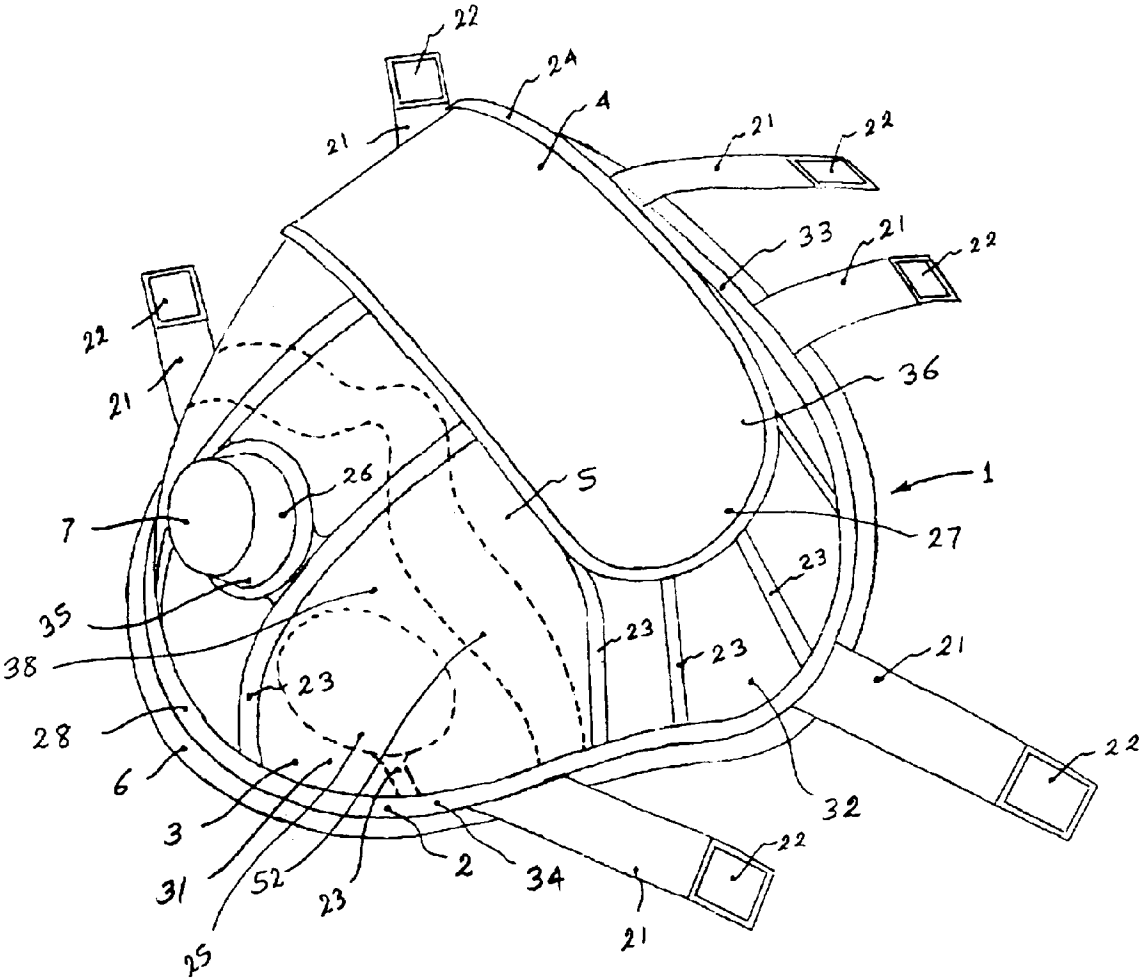
Figure (1)

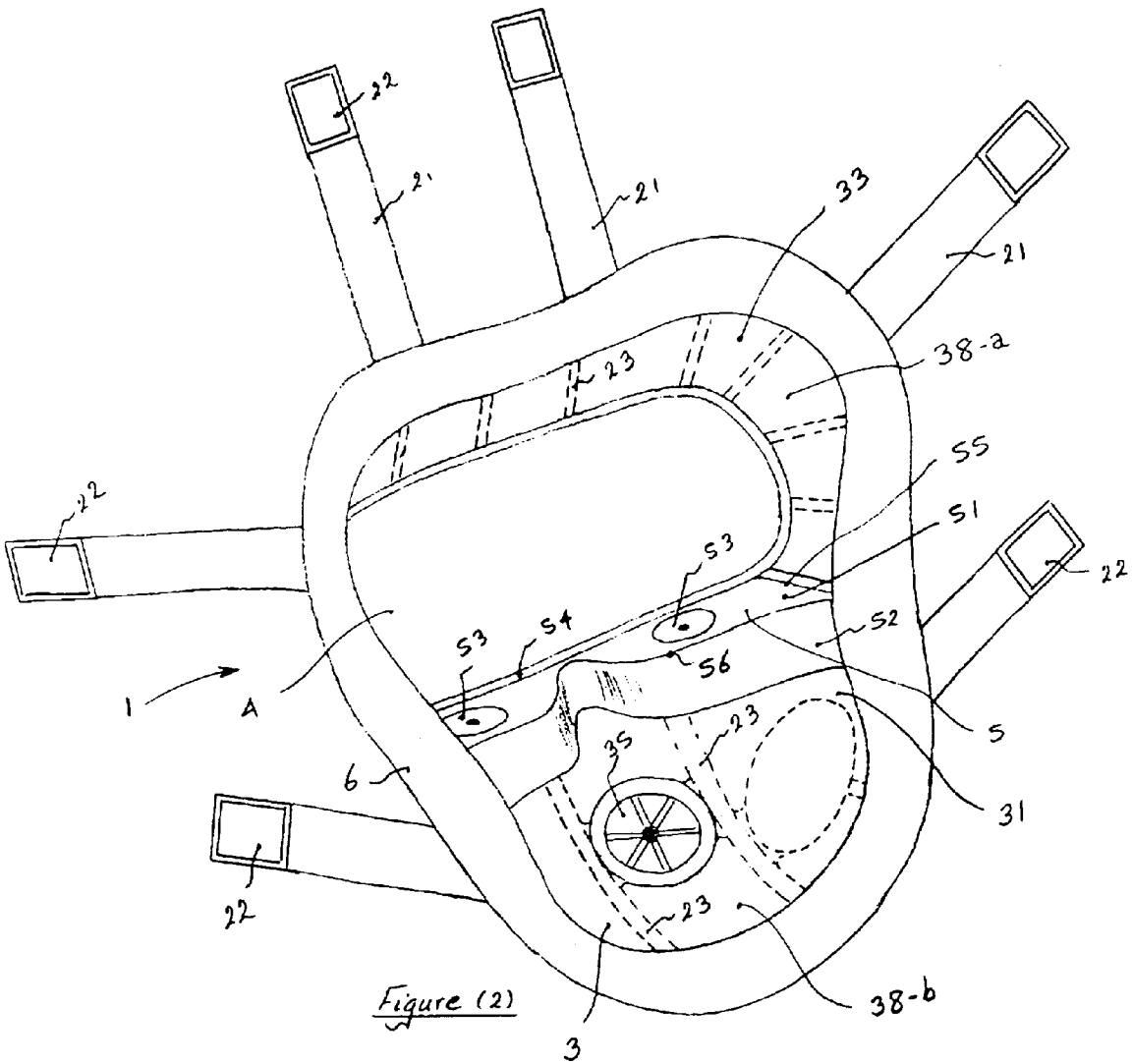
Figure (2)

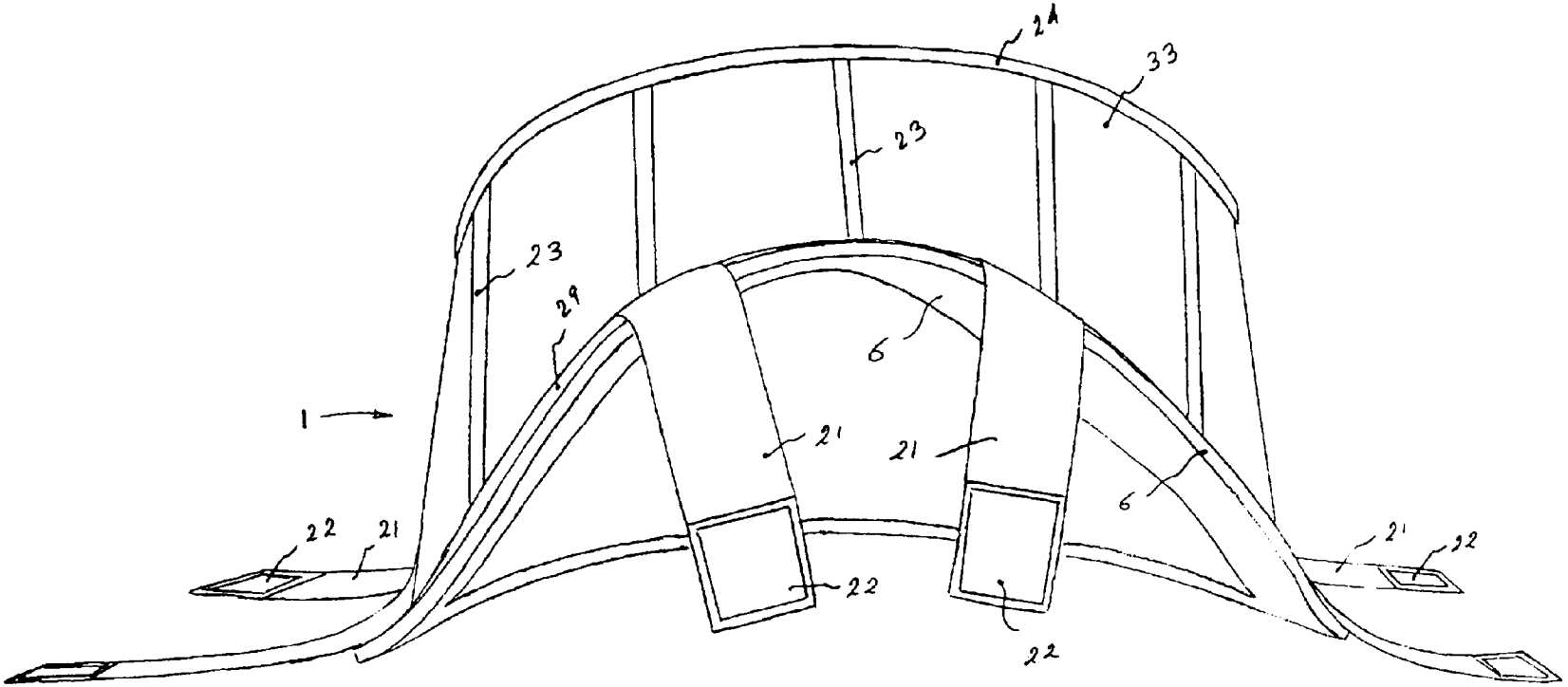
Figure (3)

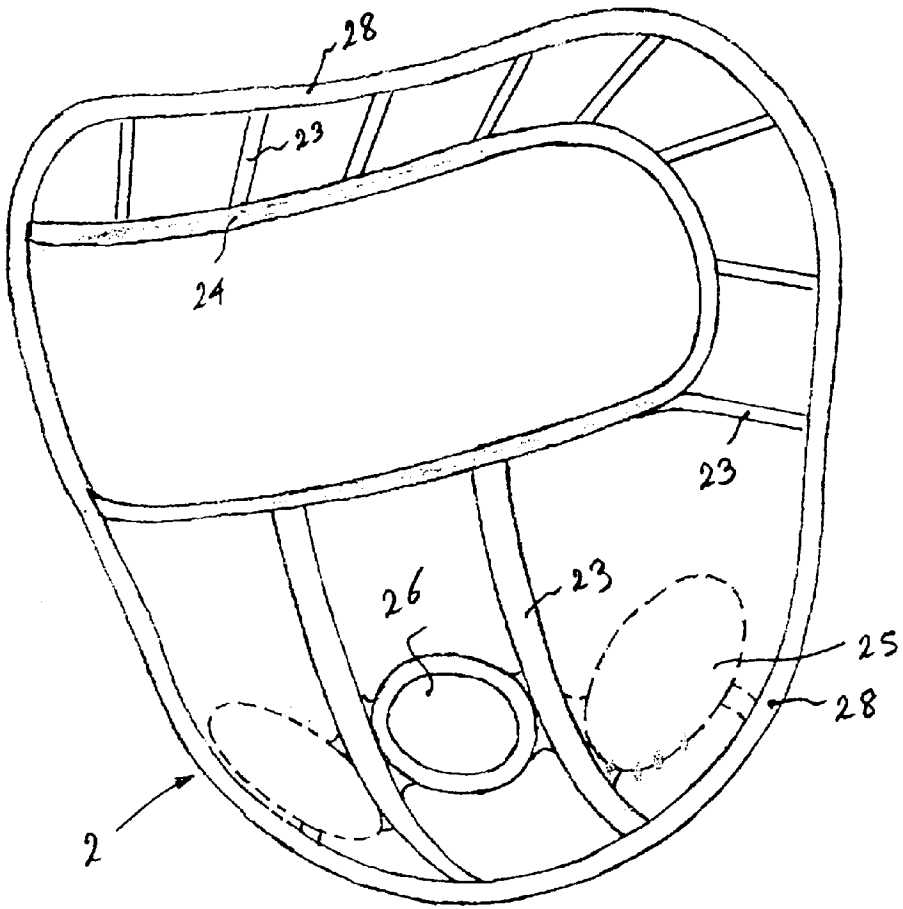
Figure (4)

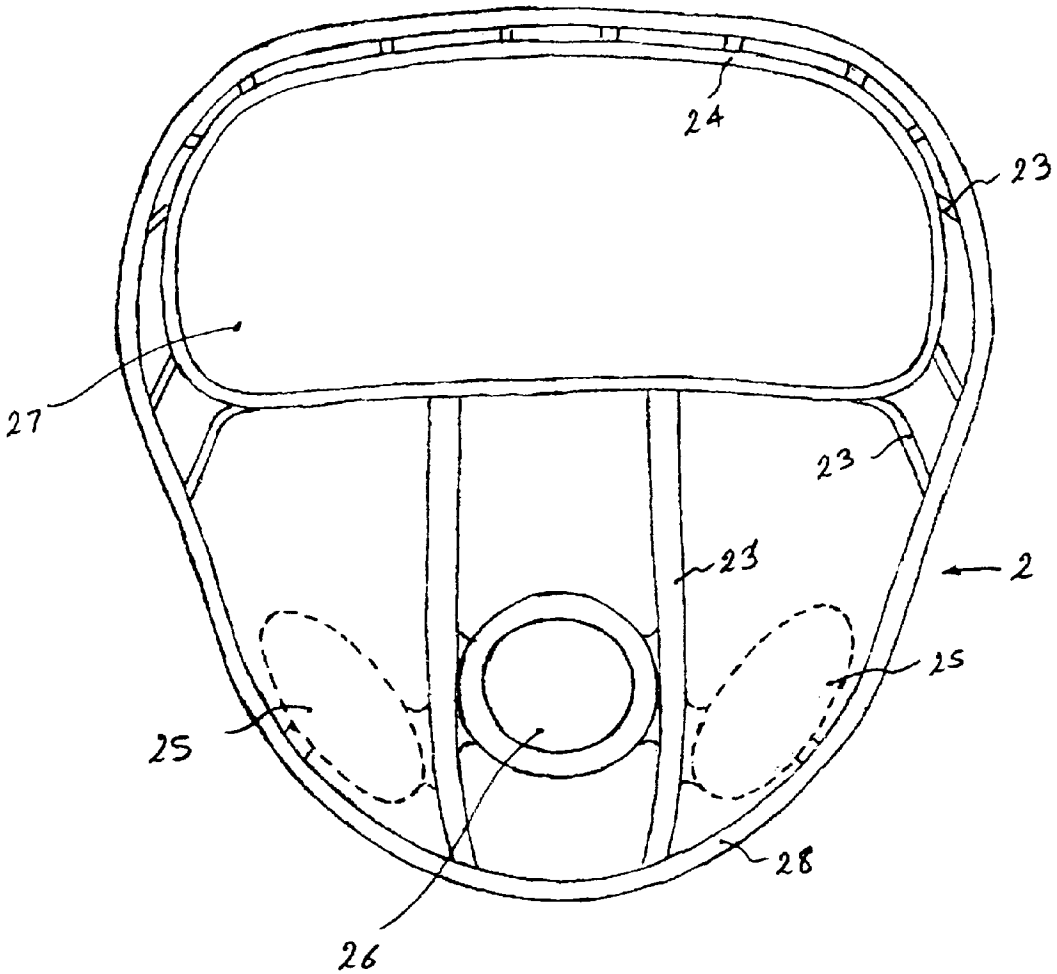
Figure (5)

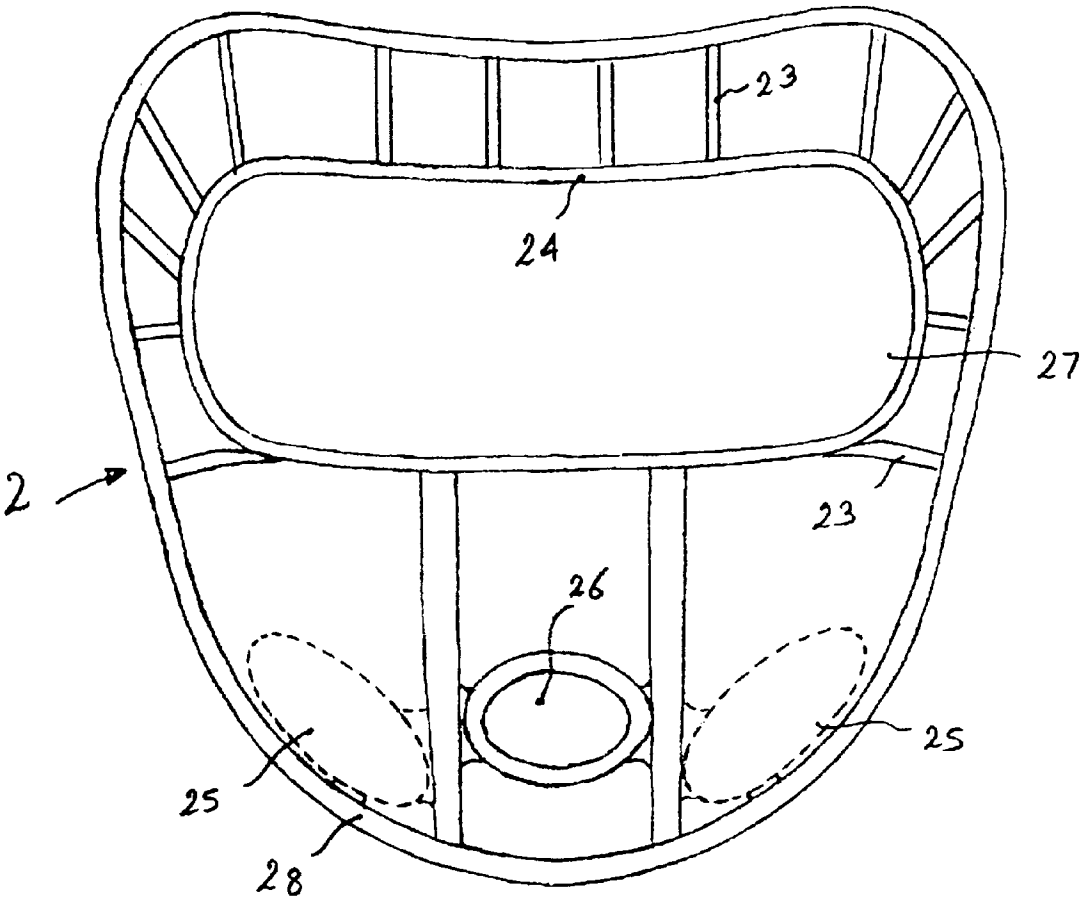
Figure (6)

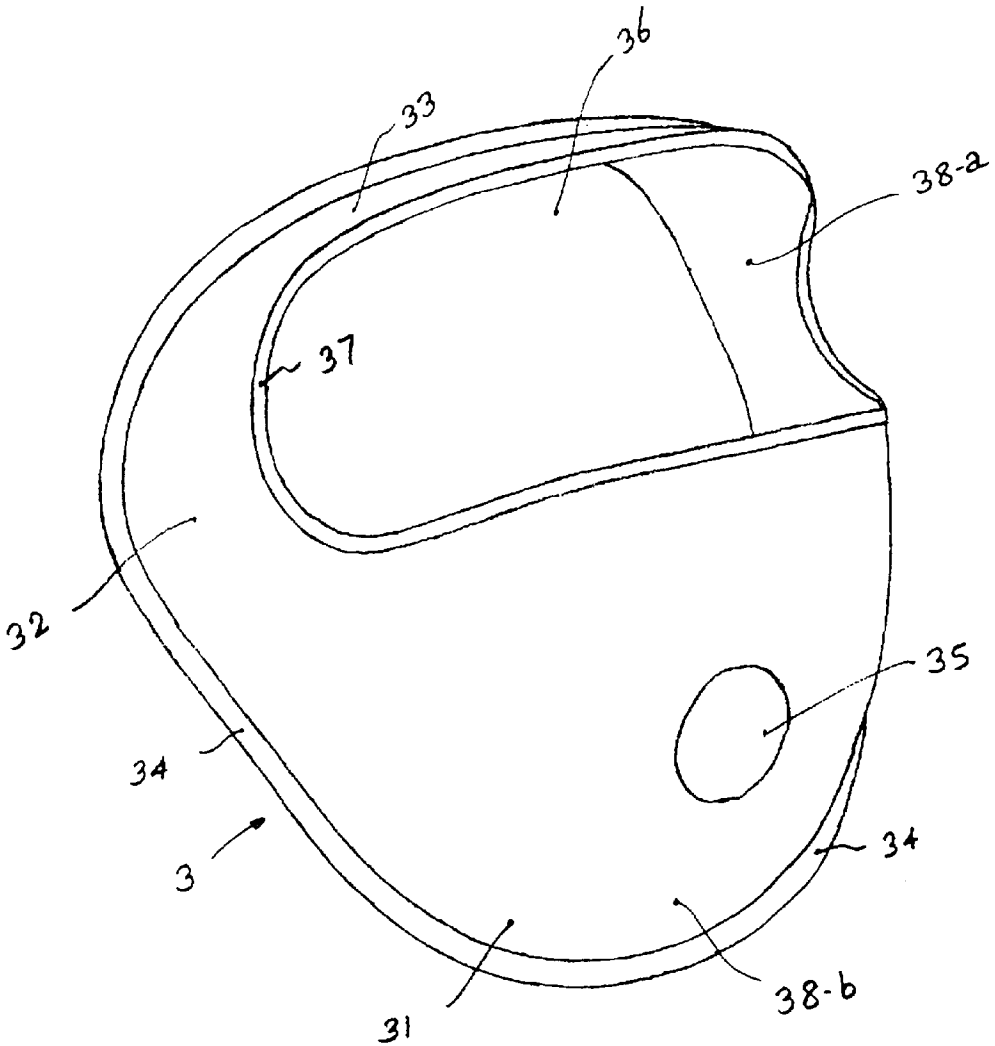
Figure (7)

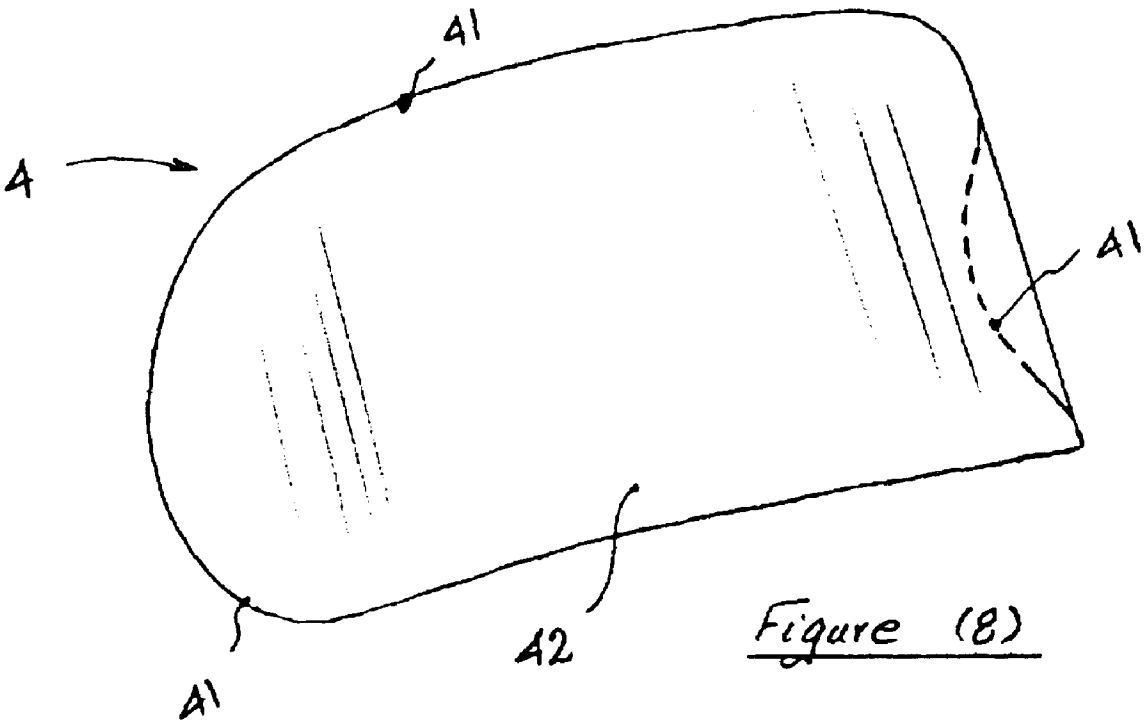
Figure (8)

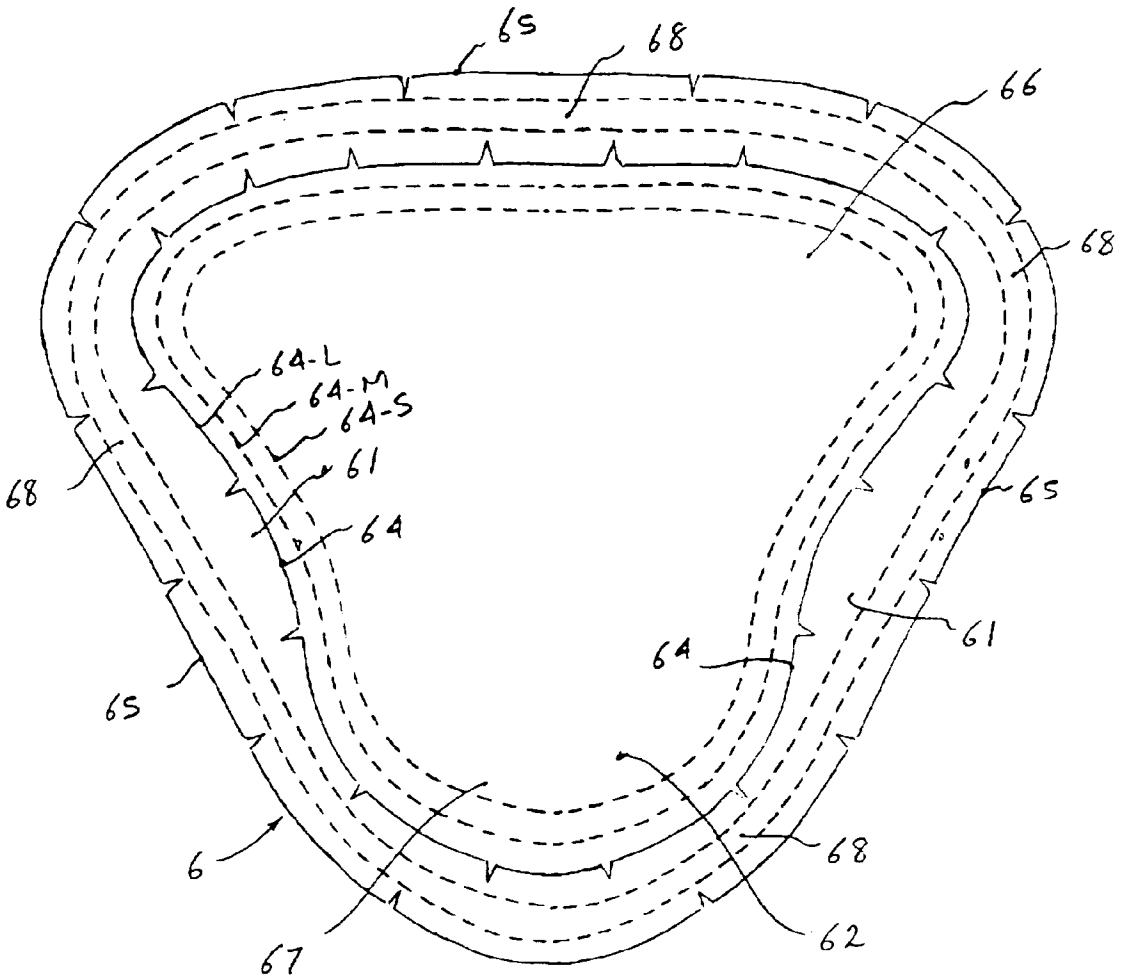
Figure (10)

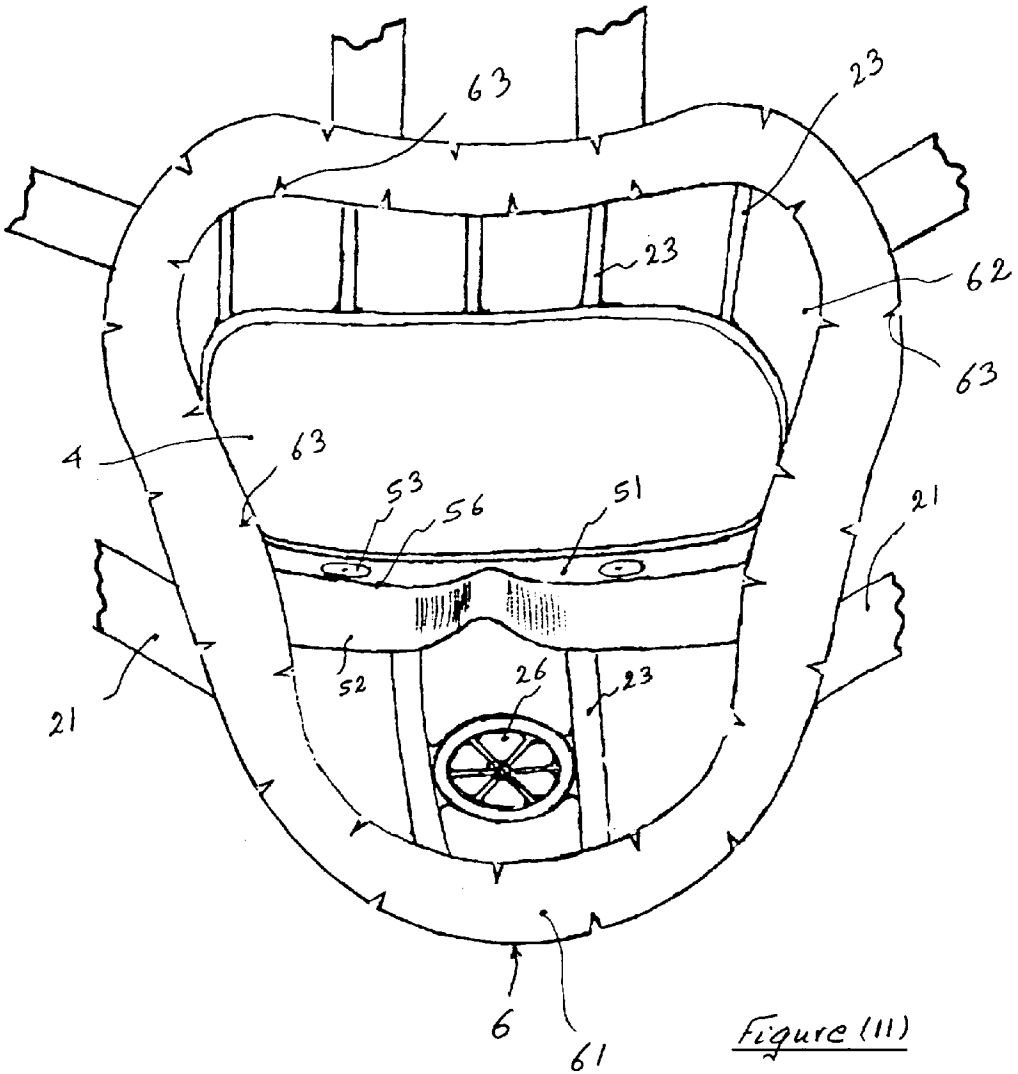
Figure (11)

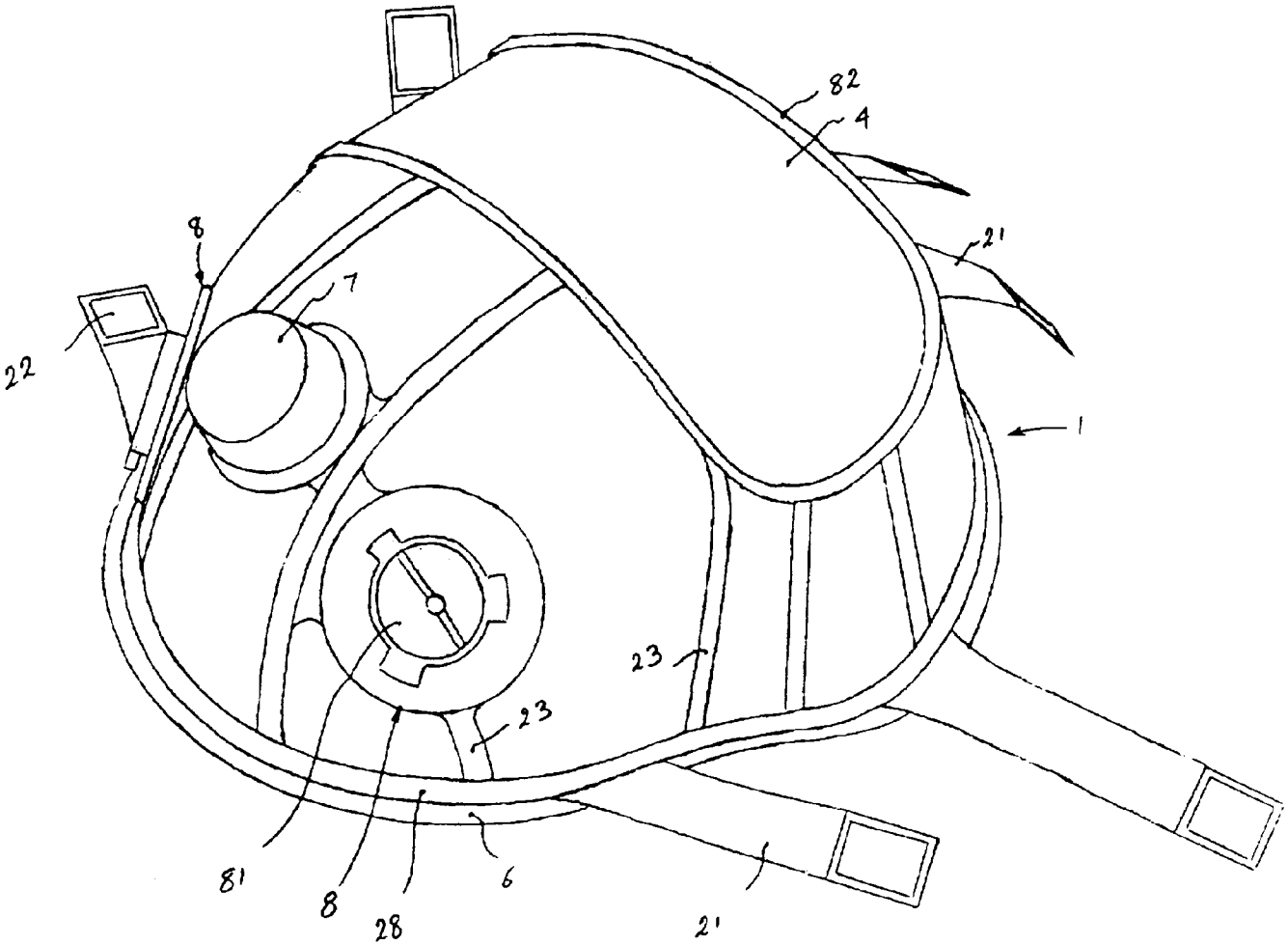
Figure (12)

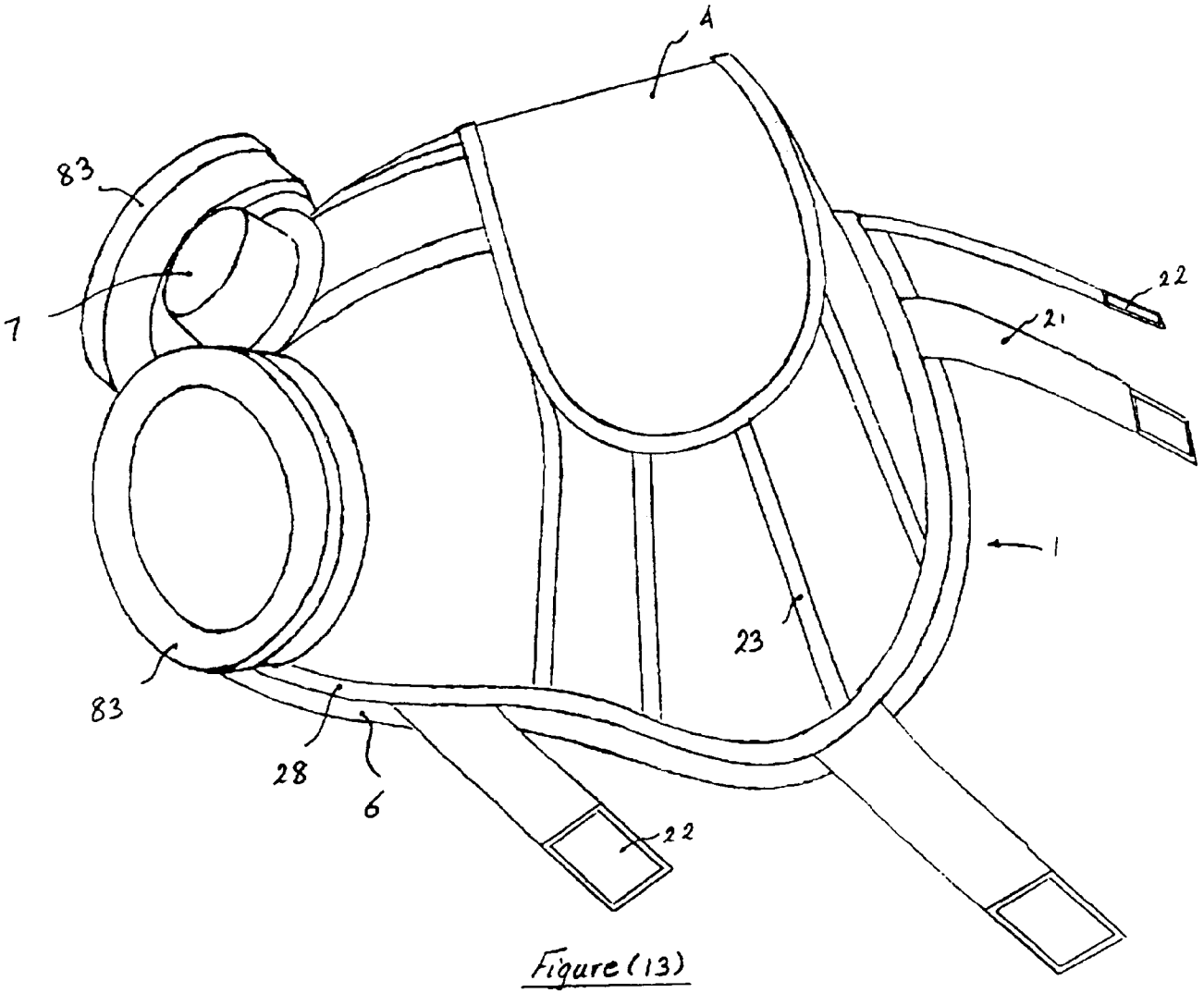
Figure (13)

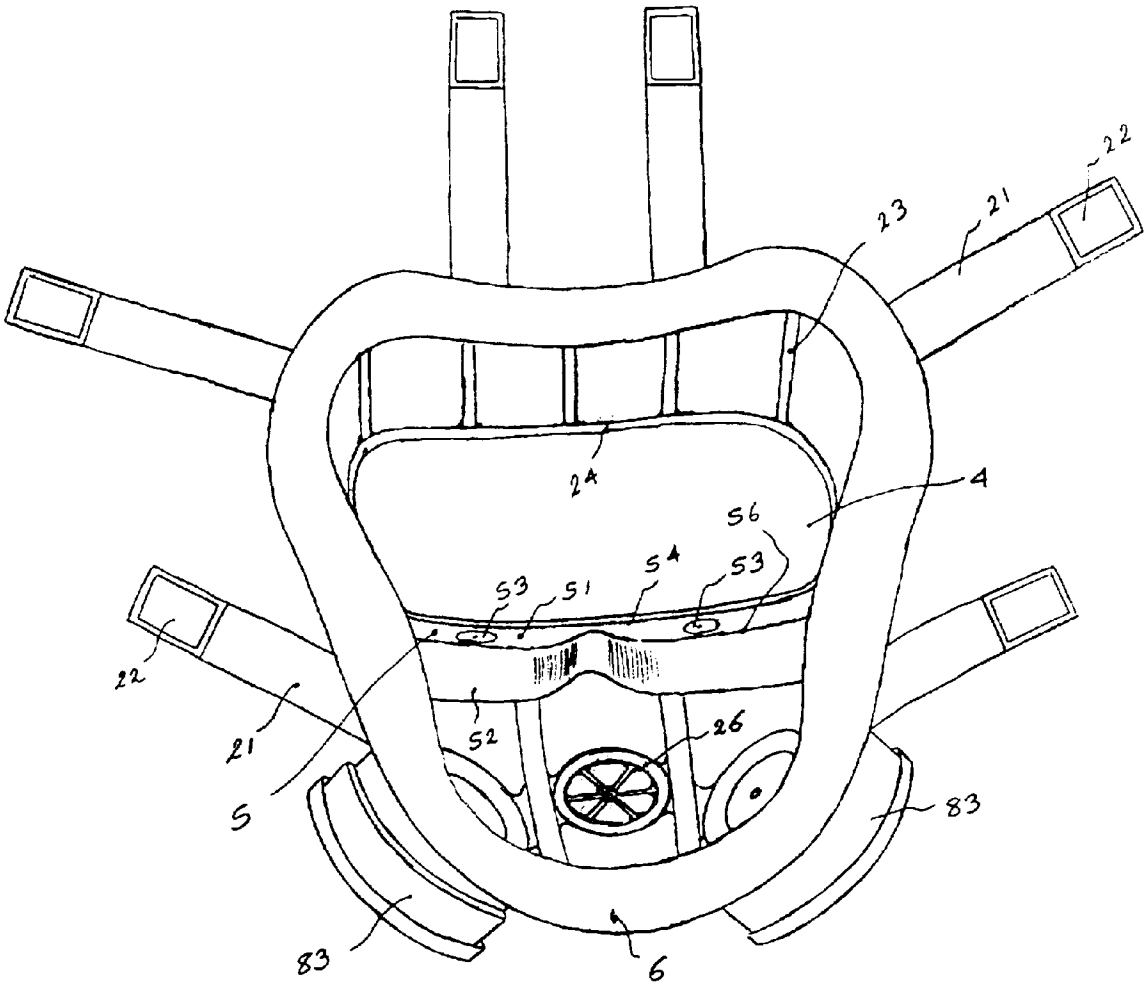
Figure (14)

FULL FACE MASK

FIGS. 1, 2 and 3 show front, rear and top isometric views of the full face mask 1 of the present invention. As shown therein, the mask comprises a support frame 2 which provides a base for support network 23 for air filtration shell 3, viewing lens 4, optional exhalation valve 7 and optional cartridge mounting adapters 8, which are shown in FIG. 12. Support frame 2 also has a support frame perimeter 28 which provides a fastening base for air filtration shell perimeter 34 and perimeter 61 of face sealing rim 6. It also provides origination points for suspension members 21. Mask 1 also comprises an air filtration shell 3 which is suitably-shaped to provide a nose and mouth portion 31, a viewing lens portion 32, a forehead portion 33, a perimeter 34, an optional opening 35 for exhalation valve 7, a window 36 for receiving viewing lens 4 and a window frame 37 for fastening viewing lens 4. Viewing lens 4 is located in viewing lens portion 32 of air filtration shell 3. Air filtration shell 3 is shaped to form a breathing chamber 38 between its interior surface and the face of wearer. For minimizing the volume of re-inhaled exhaled air and providing a cooler breathing chamber, a breathing chamber partition member 5 divides breathing chamber 38 into an upper breathing chamber 38-*a* and a lower breathing chamber 38-*b* by providing a lateral wall 51 having a contoured face-contacting border 56, which is also shown in FIG. 9. Breathing chamber partition member 5 also comprises at least one inhalation valve 53 which allows air to flow only from the upper chamber 38-*a* to the lower chamber 38-*b*. A face sealing rim 6, located between support frame perimeter 28 and the wearer's face, provides the necessary face seal effect between the wearer's face and rim 6 so that only filtered air flowing through air filtration shell 3 enters into the breathing chamber. To provide a cooler breathing chamber, an exhalation valve 7 is located on the exterior surface of the lower breathing chamber 38-*b* in order to allow warm exhaled air to flow out of the breathing chamber.

BRIEF DESCRIPTION OF THE DRAWINGS

FIG. 1 is a front isometric view of full face mask.

FIG. 2 is a rear isometric view of full face mask.

FIG. 3 is a top isometric view of full face mask.

FIG. 4 is a front isometric view of support frame.

FIG. 5 is a rear isometric view of support frame.

FIG. 6 is a front elevational view of support frame.

FIG. 7 is a front isometric view of air filtration shell.

FIG. 8 is a front isometric view of viewing lens.

FIG. 9 is an isometric view of breathing chamber partition member.

FIG. 10 shows a flat (planar) embodiment of face sealing rim.

FIG. 11 shows face sealing rim in assembled configuration of full face mask.

FIG. 12 is a front isometric view of full face mask.

FIG. 13 is a side isometric view of full face mask with cartridges attached to it.

FIG. 14 is a rear isometric view of full face mask with cartridges attached to it.

Figure 19:
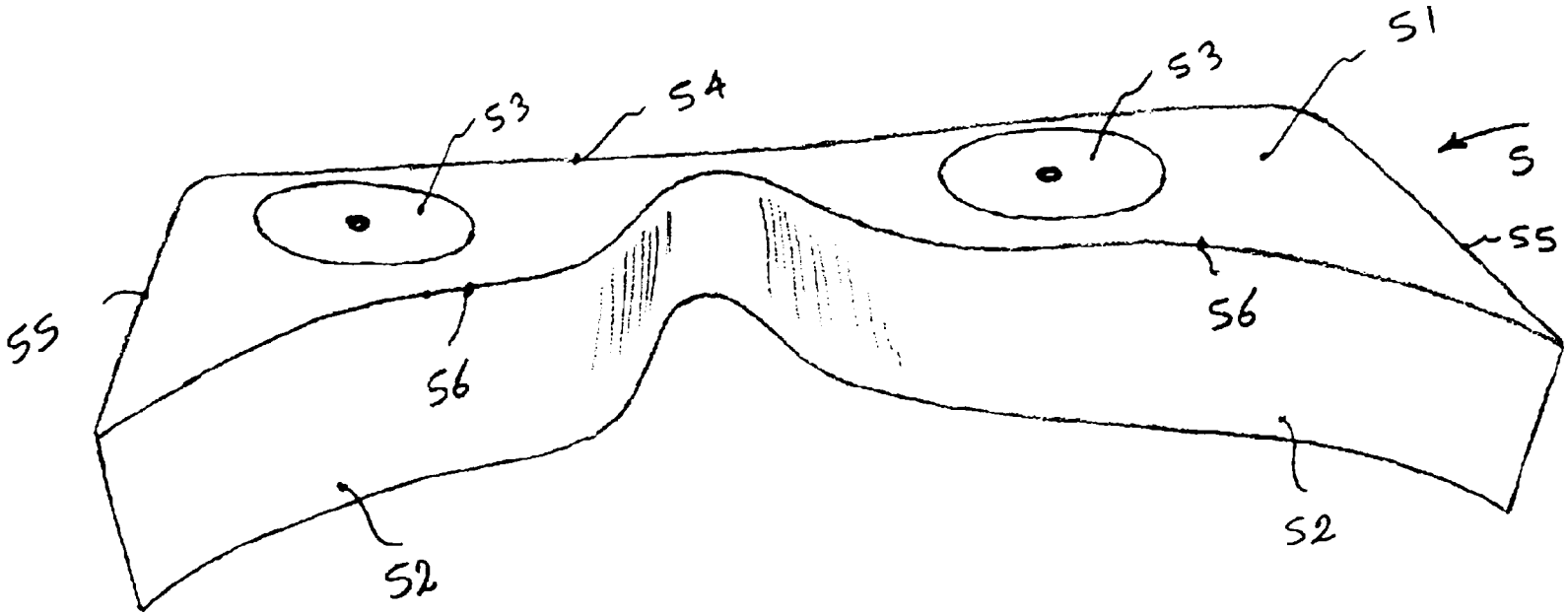

An aspect of novelty of the full face mask shown in FIGS. 1, 2 and 3 is that the air filtration function is carried out by air filtration shell 3 which has at least a portion of its surface made of a porous filtration material. In prior art full face respirators, the air filtration function is carried out by other means and the filtered air is delivered to the breathing chamber which is surrounded by an impermeable exterior shell.

Another aspect of novelty of the full face mask of the present invention is its much lighter weight, in comparison to other full face masks of the prior art performing the same function. Also, being of a lighter weight, it requires lower mounting tensions in order to effect the same face seal as the full face masks of the prior art. Therefore, it exerts lower pressure on the face of the wearer and around the head of the wearer. For example, a full face mask made of a self-supporting thermoformed laminate of N95 type filtration material and a protective netting exterior and a viewing lens made of an optical grade 0.012" Polyester sheet weighs less than 120 gm.

The full face mask of the present invention is also nestable so that a number of full face masks can be stack-packed in one container, thus reducing the packaging costs, storage volume and costs and shipping costs such advantages are very desirable for civil preparedness applications.

The full face mask of the present invention also has a lower manufacturing cost which makes it a more economic disposable alternative to cleaning or sanitizing the more costly full face masks of the prior art.

The present invention also teaches a novel method for delivering filtered air to the breathing chamber of a full face mask. The method comprises the steps of i) forming an air filtration shell 3 in the shape of a full face mask, said air filtration shell having at least a portion of its surface being of a porous nature and capable of filtering air passing therethrough from contaminants and ii) assembling said air filtration shell 3 to other full face mask components including a support frame 2, a face sealing rim 6, a viewing lens 4, an exhalation valve 7 and other components as described in this application.

The present invention also teaches a lower cost yet an effective method for providing a cooler breathing chamber 38 and minimizing the volume of re-inhaled exhaled-air in any full face mask. The method comprises the step of providing a breathing chamber partition member 5, located between the exterior shell of the full face mask and the wearer's face and dividing the breathing chamber 38 into an upper breathing chamber 38-*a* and a lower breathing chamber 38-*b*. Structural details of said partition member 5 are provided somewhere else in this application.

The present invention also provides additional methods for reducing the weight and/or cost of manufacturing/assembling full face masks by incorporating the steps of thermoforming, two-shot injection molding, encapsulation injection, and/or dip coating in manufacturing and/or assembling of certain components of full face masks, as described later on in this application.

FIG. 4 shows an isometric view of support frame 2. As shown therein, support frame 2 comprises a support frame perimeter 28 which provides a base from which support network 23 originates for supporting air filtration shell 3, viewing lens 4, optional breathing chamber partition member 5, valve 7 and optional cartridge mounting adapters 8. Support network 23 also comprises viewing lens support frame 24, viewing lens window 27, an optional support frame opening 26 for optional exhalation valve 7, optional apertures 25 for optional cartridge mounting adapters 8 and a forehead portion 29.

Support frame 2 also provides the origination points for suspension members 21 which carry suspension strap length and tension adjustment brackets 22. Suspension members 21 may be made separately and attached to perimeter 28 by stapling, adhesion, ultrasonic or heat welding, sewing or other assembly means or methods known in the art. Alternatively, they may also be snap-fit assembled in a manner that provides rotational motion capability around a snap fit assembly pin. For lower cost, they may also be integrally injection molded with support frame 2 in the same mold, thus requiring no assembly labor. Suspension strap length and tension adjustment brackets 22 are otherwise similar to those featured in prior art respirators and masks.

For enhancing the stiffness to weight ratio of support frame 2 and its support network 23, the cross-sectional shapes of their members are preferably of non-rectangular shapes. For example, a square, T, U, C, or an I-shape cross-section would provide a higher bending rigidity than an identical weight per unit length rectangular cross-section of the same material. Alternatively, a relatively rigid foam plastics material may be used for making support frame 2 and its components.

Support frame 2 may also be made from a plastics material netting sheet which is thermoformed to a three-dimensional shape, cut and punched, as desired, in order to provide window 27, apertures 25 and/or opening 26. It may also be made in the form of an injection molded perforated shell. Alternatively, it may be made from an open-cell foam material which is thermoformed to a three-dimensional shape and similarly cut and/or punched.

In another embodiment, as shown in FIGS. 12, 13 and 14, support frame 2 may be made in the form of an impermeable thin-wall shell having a window 27, an opening 26 and apertures 25. In this embodiment, however, air filtration shell 3 is not necessary since the air filtration function is carried out by externally mounted filters, filter bags, cartridges (83, shown in FIGS. 13 and 14), canisters or other air filtration means known in the art. In order to attach such externally-mounted filtration means to impermeable support frame 2, adapter(s) 8, which optionally may be integrally injection molded with support frame 2 in one mold, are used to serve the attachment function. A variety of adapter designs, known in the art, may be used including screw, bayonet, snap-on or other types. Adapters 8, shown in FIG. 12 are of the bayonet type. Alternatively also, in this embodiment, aperture(s) 25 in support frame 2 may be used for connection to other sources of breathable air such as air from a compressed air cylinder, in a self contained breathing apparatus, air from a supplied air line or air from a separately mounted powered air purifying and supplying source. An advantage this embodiment offers is that the low cost of full face mask 1 would justify treating the mask as a disposable unit instead of incurring the costs of cleaning and/or sanitization between uses. Also, in this embodiment, support frame 2 may be made by injection molding or by thermoforming. The stiffness to weight ratio of frame 2, though made of a thin polymeric material in the range of 0.020 to 0.100 inch, may be enhanced by designing the frame to have three dimensional double-curvature segments, preferably in the lower breathing chamber area, by making corrugations and/or indentations in its surface and/or by incorporating sharp intersection lines between its various segments, such as line 82, shown in FIG. 12. Also, in this embodiment, an optically correct (i.e., non-distorting) viewing lens 4 may be integrally injection molded with frame 2 either as a separate shot in a two-shot injection molding process or in a single shot injection molding process for the case of a transparent support frame 2.

FIGS. 5 and 6 show orthogonal front and rear views of support frame 2. As shown therein, all segments of support frame 2 are preferably designed with no undercuts and with a nestable (tapered) configuration. This is advantageous since it makes it possible to use a simple low cost two-plate mold with no need for in-mold slides, rotating cores, collapsing cores or other mold cost and/or molding cycle time increasing factors. This is also advantageous since it makes it possible to stack-pack a plurality of mask 1 in a single package with a low volume per mask, as compared to full face masks of the prior art.

FIG. 7 is an isometric front view of air filtration shell 3. As shown therein, shell 3 comprises a nose and mouth portion 31, a viewing lens portion 32, a forehead portion 33, a perimeter 34, an opening 35 for exhalation valve 7, a window 36 for receiving viewing lens 4 and a window frame 37 which surrounds viewing lens 4. Its three-dimensional form is suitably shaped to cover the nose, mouth and eyes of the wearer and to form a perimeter 34 which surrounds the forehead, temples, cheek-bones, cheeks and chin areas.

In its simplest form, air filtration shell 3 is made of a porous fibrous material or an open-cell foam material capable of filtering particulates passing through it. It may also include or be impregnated with other media, particulates or granules (for example; activated carbon granules) capable of absorbing certain gases or vapors. Such materials are known in the art and are available with various and wide-ranging characteristics such as resistance to flow (expressed in mm of water at a certain flow speed in cm/second), particulate filtration efficiency (expressed in % for a certain particulate size), vapor and gas absorption capacity and efficiency, . . . etc.

Air filtration shell 3 may comprise a single layer of filtration material or be made of a plurality of successive layers forming a laminate where each layer serves a particular function. For example, a fibrous filtration sheet material may be combined with an exterior and/or an interior layer of a thermoplastic netting sheet in order to produce a self-supporting thermoformable laminate with enhanced structural rigidity of the thermoformed shell and a protective exterior mesh on the outer surface of air filtration shell 3. Another example of such a laminate may be obtained by sandwiching a polypropylene or polyester melt blown micro-fiber filtration media sheet between two layers of a thermoformable needle-punched non-woven fabric or between a layer of thermoformable needle-punched non-woven fabric and a thermoplastic polyvinylchloride or polyethylene netting sheet. An example of such a netting sheet is a low density polyethylene netting having a string diameter of 0.034", a thickness of 0.075", diamond-shaped apertures of 0.200"×0.170" and an areal density of 0.0725 lbm/square foot (1.16 oz/square foot). The resulting laminate is then thermoformed into the desired air filtration shell shape and its perimeter 34, window frame 37 and opening 35 are simultaneously or sequentially cut. With the plastic netting located on the outside of the thermoformed shell, air filtration shell 3 possesses an attractive exterior appearance, a self-supporting structural rigidity and a protected sandwiched filtration media at low material and labor costs. Other reinforcement scrims or netting materials, known in the art, may also be included in the above-described laminates.

The stiffness to weight ratio of air filtration shell 3 may also be enhanced by incorporating three-dimensional double-curvature segments, preferably in its nose and mouth portion 31 and corrugations and/or indentations in its shape so that it would offer a higher resistance to buckling under externally-applied forces and/or high tensions exerted by mounting straps.

Another advantage that a sandwiched laminate, having an exterior netting made of a polymeric (thermoplastic or thermosetting) material is that one can use the color of the exterior material as a means or a method for indicating the type and filtration efficiency and/or capacity of the full face mask. For example, a white-color netting material may be used to indicate an N-type particulates filtration capability. Likewise, an orange-color netting material for R-type particulates, a magenta-color netting material for P-type particulates and a black-color netting material for organic vapor absorption capability. Other colors may be used to indicate other respective functions and/or filtration capabilities and capacities.

Another advantage of using sandwiched laminates is that by selecting suitable thermoformable self-supporting laminate layers, one may be able to eliminate the need for support frame 2 and apply face sealing rim 6 directly to the perimeter 34 of air filtration shell 3. This may be accomplished by a dip coating process, by an encapsulation molding process or through a bonding process of face sealing rim 6, directly or indirectly, to perimeter 34 of air filtration shell 3. Encapsulation process is, herein summarized, as an injection molding process in which a) the mating halves of a mold form a pinch line which i) clamps on or near the edge or perimeter, to be encapsulated, of a previously-made component, ii) defines on one side a first cavity for injection of encapsulating material and on the other side a second cavity that houses the previously-made component and iii) prevents flow of encapsulation material into the second cavity and b) injecting encapsulating material in said first cavity. It may also be used for joining two components. In this case, the mating halves of a mold form two pinch lines or perimeters. The first pinch line clamps on or near the edge or perimeter of the first component and the second pinch line clamps on or near the edge or perimeter of the second component. The space between the two pinch lines or perimeters defines a cavity for injection of encapsulation material while the pinch lines prevent flow of the encapsulation material outside of the cavity for injection of encapsulation material. The injected encapsulation material may be in the form of a molten thermoplastic polymeric material or a liquid reaction injection molding solution comprising at least two reactive ingredients.

Air filtration shell 3 may also be made by a hydro-forming process. As the name of the process implies, filtration fibers, in an aqueous suspension are deposited, by vacuum or pressure differential application, onto a porous mold of the desired shape. The aqueous solution is extracted and the deposited filtration fibers take the shape of the mold. Subsequently, the hydro-formed filtration shell is dried and placed, either separately or together with other layer(s) into support frame 2 and bonded to support frame perimeter 28 and/or support network 23. Additionally, the hydro-forming process, described above, may, be used to increase the area available for air flow, through air filtration shell 3, by-forming corrugations or at least one collapsing cone within the surface of air filtration shell 3. The aqueous suspension may include an adhesive for enhancing the structural integrity of the hydro-formed shell. It may also include cellulosic fibers, such as wood pulp fibers, which, upon drying, generate hydrogen bonds at their points of cross-over or contact. The above-described hydro-forming process is similar to that of making egg cartons from recycled cellulosic fibers obtained from recycled newspapers.

FIG. 8 shows an isometric view of viewing lens 4. Viewing lens 4 is an optically-correct (i.e., causing no distortion of viewed-through objects) transparent lens 42 having a perimeter 41 shaped to fit in viewing lens window and is bonded to the perimeter of viewing lens frame 24. In embodiments where no support frame 2 is used, viewing lens perimeter 41 is received in and bonded to air filtration shell window 36.

When lens 4 is made by injection molding, perimeter 41 and curvature(s) of the surface of lens 42 may be designed to take any desired and achievable shapes and/or curvature (s). Alternatively, for lower cost, viewing lens 4 may be die cut from an optically-correct transparent sheet of plastics material. For example, an optical grade polyester or polycarbonate transparent plastic sheet (0.012" thick) may be used for producing lens 4 by die cutting. Other sheet thicknesses may also be used.

The surface of lens 4 may also be coated by an anti-fog, a scratch-resistant, an anti-static and/or any other surface coating known in the art.

The perimeter 41 of viewing lens 4 may also be bonded to air filtration shell window frame 37 by adhesives, heat sealing, ultrasonic sealing or by an encapsulation process, as described earlier.

FIG. 9 shows an isometric view of optional breathing chamber partition member 5. As shown therein, partition member 5 comprises a lateral wall 51 which is surrounded with and defined by a front border 54, side borders 55 and a contoured face-contacting border 56 which is shaped to effect a seal between lateral wall 51 and the nose bridge and cheeks of the wearer's face. Optionally, for a more effective seal between lateral wall 51 and the nose bridge and cheeks areas of the wearer's face, a partition member sealing skirt 52 is provided along the border of contoured face contacting border 52. Optionally, lateral wall 51 of partition member 5 includes at least one inhalation valve 53 which allows flow of air only from the upper breathing chamber 38-*a* to the lower breathing chamber 38-*b*. Inhalation valves are known in the art and are commonly used on filtered air flow openings of filtration cartridges.

It is desirable and preferable, in accordance with the present invention that sealing skirt 52 and contoured face contacting border 56 be made of soft materials, such as flexible polymeric films or foams. Similar to other components of mask 1, breathing chamber partition member 5 may be made separately and assembled onto the interior of air filtration shell 3 or the interior of support frame 2. Likewise, it may be integrally injection molded, with support frame 2, in a two-shot injection molding process and adapted with a soft contoured face-contacting border 56.

FIG. 10 shows a flat (planar) embodiment of face sealing rim 6 prior to its application to mask 1. As shown therein, face sealing rim 6 has a suitably shaped perimeter 61 and an aperture 62. Perimeter 61 serves the purpose of directly contacting the wearer's face and effecting a continuous seal between itself and the wearer's forehead, temples, cheekbones, cheeks and chin areas and is defined by an interior outline 64 and an exterior outline 65. Interior outline 64 is suitably shaped, as shown in FIG. 10, to provide a wider viewing lens area 66 and a narrower nose and mouth area 67.

Face sealing rim 6 is made of a flexible material which is easily bent in order to conform to the shape of support frame perimeter 28. It is also desirable that its material be easy to deform in a shear mode of deformation so that it may take three-dimensional double-curvature deformations as it contacts certain areas of the wearer's face; for example the transition areas from the temples areas to the forehead area and the transition areas from the cheek areas to the chin area.

In order to obtain a more effective seal between face seal rim 6 and the wearer's face, it is preferable that slits 63 be made in interior and/or exterior outlines 64 and 65, but outside of the assembly area 68 where sealing rim 6 is attached to support frame perimeter 28. In order to accommodate various wearer's face sizes, interior perimeter outline 64 may be designed to provide a small, a medium or a large aperture by being cut along lines 64-S, 64-M or 64-L, respectively, as shown in FIG. 10.

A preferred material for face sealing rim is a flexible closed-cell foam material. It should be of an inert nature, i.e., does not interact with, harm or irritate the wearer's skin and preferably be selected from materials approved for face/skin contact by the Food and Drug Administration. An example of such a material is a thermoformable closed-cell foam sheet material marketed by Voltec company under the Tradename Volara®. A typical thickness of such a sheet material for use in face sealing rim 6 is in the range of 1/32 inch to 1/4 inch with a density in the range of 2 to 12 lbm per cubic foot. Such a sheet material is die cut to the desired shape as defined by interior outlines 64-S, 64-M or 64-L, exterior outline 65 and slits 63. Alternatively, face sealing rim 6 may be made by injection molding.

FIG. 11 shows face sealing rim 6 in an assembled configuration of full face mask 1. Methods of assembly of face sealing rim on mask 1 include heat sealing, ultrasonic sealing, adhesion, snap-on or other methods known in the art.

Also, depending on the construction of mask 1, face sealing rim 6 may be assembled to support frame perimeter 28 or, in the absence of support frame 2, directly to the perimeter 34 of air filtration shell 3.

For lower manufacturing cost and waste minimization, face sealing rim 6 may be injection molded together with support frame 2 in a two-shot injection molding process. In this process, a first injection shot is made into a first cavity of the shape and dimensions of support frame 2. Next, the mold halves are opened and rotated or shifted relative to one another and reclosed in order define and form a second cavity which provides room for a second injection shot in which the face sealing rim material is applied, in a molten state, onto the first injection shot, i.e., on the support frame perimeter. Injection molding machines capable of two-shot injection molding are made by NETSTAL Company.

Face sealing rim 6 may also be formed and applied to perimeter 28 of support frame 2 or to perimeter 34 of air filtration shell 3 by a dip coating process. Alternatively, face sealing rim 6 and/or support frame 2 may be made by reaction injection molding, separately or by a two-shot reaction injection molding process.

A variety of polymeric materials having the suitable deformation characteristics mentioned earlier are known in the art and could be used for making sealing rim 6 and support frame 2. Also, for welding and similar applications, the materials of exterior components of mask 1 may be selected from flame-retarding and/or self-extinguishing materials or be treated to become flame-retardant or self-extinguishing.

Alternatively, as mentioned earlier and depending on the construction of mask 1, face sealing rim 6 may be assembled directly to the perimeter 34 of air filtration shell 3. Again, for lower manufacturing cost and waste minimization, face sealing rim 6 may be injection molded in an encapsulation injection process, described earlier, around the perimeter 34 of a previously-formed air filtration shell 3.

What is claimed is:

1. A full face mask comprising; an air filtration shell, said shell being made of a filtration material and having a three dimensional form suitably shaped to cover the nose, mouth and eyes of the wearer and to form a perimeter which surrounds the forehead, temples, cheek-bones, cheeks and chin areas of the wearer, said shell comprising a nose and mouth portion, a viewing lens portion, a forehead portion, a perimeter, a window for receiving a viewing lens and a window frame, a viewing lens, said viewing lens being an optically-correct transparent lens having a perimeter shaped to fit in said window and being bonded to the perimeter of said window frame, a face sealing rim made of a flexible material and having a suitably shaped perimeter and an aperture, said face sealing rim being attached to said perimeter of said air filtration shell and directly contacting the wearer's face and effecting a continuous seal between itself and the wearer's forehead, temples, cheek-bones, cheeks and chin areas, said shaped perimeter of said face sealing rim being defined by an interior outline and an exterior outline, said interior outline being suitably shaped to provide a wider viewing lens area and a narrower nose and mouth area, said mask further comprising a breathing chamber partition member that divides said breathing chamber into an upper breathing chamber and a lower breathing chamber, said partition member comprising a lateral wall which is surrounded with and defined by a front border, side borders and a contoured face-contacting border which is shaped to effect a seal between said lateral wall and the nose bridge and cheeks of the wearer's face, said lateral wall of said breathing chamber partition member further comprising at least one inhalation valve, said inhalation valve allowing flow of air only from the upper breathing chamber of said air filtration shell to the lower breathing chamber of said air filtration shell.

* * * * *